US008515316B2

(12) United States Patent
Matsumoto et al.

(10) Patent No.: US 8,515,316 B2
(45) Date of Patent: Aug. 20, 2013

(54) DEVELOPING DEVICE AND IMAGE FORMING APPARATUS

(75) Inventors: Junichi Matsumoto, Kanagawa (JP); Tomoya Ohmura, Kanagawa (JP); Natsumi Matsue, Kanagawa (JP); Yasuo Takuma, Kanagawa (JP); Hiroshi Kikuchi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 215 days.

(21) Appl. No.: 13/046,000

(22) Filed: Mar. 11, 2011

(65) Prior Publication Data

US 2011/0229207 A1 Sep. 22, 2011

(30) Foreign Application Priority Data

Mar. 16, 2010 (JP) ..... 2010-059941

(51) Int. Cl.
*G03G 15/08* (2006.01)

(52) U.S. Cl.
USPC ..... 399/254; 399/260

(58) Field of Classification Search
USPC ..... 399/58, 254, 255, 258–260
See application file for complete search history.

(56) References Cited

U.S. PATENT DOCUMENTS

| | | | | |
|---|---|---|---|---|
| 7,130,558 | B2 | 10/2006 | Matsumoto et al. | |
| 7,346,286 | B2 | 3/2008 | Matsumoto et al. | |
| 7,356,288 | B2 | 4/2008 | Iwata et al. | |
| 7,406,278 | B2 | 7/2008 | Katsuyama et al. | |
| 7,636,536 | B2 | 12/2009 | Iwata et al. | |
| 7,729,642 | B2 | 6/2010 | Matsumoto et al. | |
| 7,783,233 | B2 | 8/2010 | Iwata et al. | |
| 7,792,472 | B2 | 9/2010 | Ichikawa et al. | |
| 7,835,653 | B2 | 11/2010 | Katoh et al. | |
| 2007/0154242 | A1 | 7/2007 | Matsumoto et al. | |
| 2007/0166079 | A1* | 7/2007 | Ichikawa et al. | 399/254 |
| 2008/0226349 | A1 | 9/2008 | Iwata et al. | |
| 2008/0298844 | A1 | 12/2008 | Katoh et al. | |
| 2008/0298845 | A1 | 12/2008 | Ohmura et al. | |
| 2008/0298866 | A1 | 12/2008 | Matsumoto et al. | |
| 2009/0028611 | A1 | 1/2009 | Matsumoto et al. | |
| 2009/0067886 | A1* | 3/2009 | Nodera et al. | 399/262 |
| 2009/0123174 | A1* | 5/2009 | Iwata et al. | 399/92 |
| 2009/0317106 | A1 | 12/2009 | Ohmura et al. | |
| 2010/0061774 | A1 | 3/2010 | Iwata et al. | |
| 2010/0124443 | A1 | 5/2010 | Ohmura et al. | |
| 2010/0143000 | A1 | 6/2010 | Matsue et al. | |

FOREIGN PATENT DOCUMENTS

| | | |
|---|---|---|
| JP | 4-198966 | 7/1992 |
| JP | 8-123198 | 5/1996 |
| JP | 8-211723 | 8/1996 |
| JP | 2007-193301 | 8/2007 |
| JP | 2008-3561 | 1/2008 |

* cited by examiner

*Primary Examiner* — David Gray
*Assistant Examiner* — Thomas Giampaolo, II
(74) *Attorney, Agent, or Firm* — Oblon, Spivak, McClelland, Maier & Neustadt, L.L.P.

(57) ABSTRACT

A developing device includes a developer supply part and a developer collecting part, wherein the developer supply part has a developer inlet port for introducing a developer supplied from a reservoir into the developer supply part and a developer extraction port provided on the side of the developer inlet port to remove a portion of the developer so as to define a quantity of the developer to be introduced in the developer supply part, and wherein the developer extraction port and the developer collecting part are connected to the reservoir.

13 Claims, 10 Drawing Sheets

A (g/sec) : QUANTITY OF DEVELOPER OUTPUT FROM RESERVOIR 40
B1 (g/sec) : QUANTITY OF DEVELOPER SUPPLIED TO DEVELOPER SUPPLY PART 30A
C (g/sec) : QUANTITY OF DEVELOPER COLLECTED AT OR ABOVE PRESCRIBED CIRCULATION FLOW
B2 (g/sec) : QUANTITY OF DEVELOPER COLLECTED FROM DEVELOPER COLLECTING PART 30B
D (g/sec) : QUANTITY OF DEVELOPER FED BACK TO RESERVOIR 40

A = D
B1 = B2
B1 + C = A
B2 + C = D

DEVELOPING DEVICE AND IMAGE FORMING APPARATUS

TECHNICAL FIELD

The present invention generally relates to a developing device and an image forming apparatus, and more particularly, to a circulating mechanism for a two-component (binary system) developer.

BACKGROUND ART

In an image forming apparatus, such as a copy machine, a facsimile machine or a printing machine, an electrostatic latent image is formed by a light on a photoreceptor and the electrostatic latent image is developed into a toner image by a developing device. Then the toner image is transferred as a visualized image onto a sheet so as to output recorded information.

There are two types of developer used in the development process. One is magnetic or nonmagnetic single-component developer and the other is two-component (binary system) developer containing toner and carrier for carrying toner particles. When these components are mixed, toner particles are electrically charged due to frictional electrification caused by the stirring/mixture process and become attached to the electrostatic latent image via electrostatic attraction.

A known structure of a developing device is a combination of a developing sleeve and a stirring sleeve. The developing sleeve produces particle clusters along its circumferential surface to supply the toner particles onto an electrostatic latent image on a photoreceptor. The stirring sleeve supplies the stirred and mixed developer to the developing sleeve. After the visualization of the electrostatic latent image on the photoreceptor, the remaining developer from which toner particles have been used is collected in the developing device.

The two-component developer is stirred and mixed in a developer tank, during which process the toner particles are electrically charged. If electrification is insufficient, the image density is adversely affected and the image quality is likely to be unstable. Especially if the electrification level is less than a predetermined level, the image density cannot be maintained at a desired level. In addition, toner particles are suspended and attached to the background surface of the photoreceptor, which phenomenon is called background contamination. If the electrification level is over the predetermined level, too large an amount of toner particles adhere to the image, which results in a so-called covered image.

To overcome the above-described problems, it is proposed to provide a stirring part separated from the developing device and supply the stirred developer to the developing device by means of a feed screw (See, for example, Patent Document 1). Another known structure is to provide circulating means to connect a developing part and a stirring part that is adapted to supply toner particles to the developing part making use of air current (See, for example, Patent Document 2). In the latter document, the stirring part performs the stirring process in accordance with the state of the developer to supply a developer with an appropriate toner concentration and electrification level to the developing part.

Thus, feed screw means or air-draft feeding means are employed in the conventional techniques to supply stirred and mixed developer from a stirring part to a developing device. However, the quantity of developer supplied using the known techniques depends on the rotational speed of a screw or a rotary feeder having rotatable blades arranged in a radial fashion along the circumference of the port, and the feeding quantity may vary according to aging variation of the developer.

If the fluidity of the developer degrades due to the environmental conditions or long-term use, the feeding quantity will vary. If the developer is fed by a feeding screw in a direction against gravitational force, the volume of the developer being fed will change depending on the toner concentration. Some portions of the developer may be fed back in the opposite direction. Thus the feeding quantity of the developer cannot be maintained constant.

Still another problem caused by use of a screw or a rotary feeder is that an air gap is generally provided between the inner wall of the housing and the screw or the rotary feeder. For this reason, the sealing characteristic may be insufficient, and this may cause the feeding quantity to be inconsistant.

Air-current feeding of the developer may be desirable compared with use of a screw; however, it is difficult for the air-current feeding method to check the actual quantity of the developer being fed in the developing device, especially the quantity of the developer fed to the developer supply port although a rotary feeder is able to define a quantity of feeding. Furthermore, the quantity of developer introduced in the developing device may vary depending on a change in the environmental conditions such as humidity or a change in the feeding conditions such as a feeding volume.

If the quantity of developer supplied to the developing device is short of a required quantity, the image density become unstable. If too great a quantity of developer is supplied to the developing device, the developer will overflow and scatter in the surroundings.

Patent Document 1: JP H04-198966 A

Patent Document 2: JP 2008-3561 A

DISCLOSURE OF INVENTION

In view of the above-described technical problems in the conventional developing devices, especially those arising from the conventional feeding structures extending from stirring parts to the developing devices, it is an objective of the invention to provide a developing device and an image forming apparatus that can stabilize a quantity of developer supplied in the developing device regardless of a change in the environmental conditions or the volume of the developer.

To achieve the above-described object, in one aspect of the invention, a developing device includes:

a developing unit configured to visualize an electrostatic latent image formed on a latent image support member using a developer that contains toner and carrier, the developing unit including a developer supply part and a developer collecting part; and a circulation path configured to collect the developer from the developing unit and feed the collected developer to the developer supply part, the circulation path including a reservoir provided before the developing unit to store and stir the developer, wherein the developing supply part has a developer inlet port configured to introduce the developer supplied from the reservoir into the developing supply part and a developer extraction port provided on a side of the developer inlet port to remove a portion of the developer to define a quantity of developer to be introduced in the developer supply part.

In a preferable example, the developer extraction port is configured to allow said portion of the developer to be supplied to the reservoir.

For example, a quantity of the developer supplied from the reservoir to the developer inlet port is at or above a defined quantity of circulation required for the developing supply part.

The developer extraction port may be configured to collect an excess quantity of the developer over a defined quantity of circulation required for the developer supply part, making use of a weight of the developer itself.

Preferably, the developer extraction port has an area size that removes a quantity of the developer less than a feed rate of a developer feeding member provided in the developer supply part at a feed start position of the developer feeding member.

As an example, the developer extraction port is structured as an opening overlapping the feed start position of the developer feeding member.

In a preferred example, the reservoir provided in the circulation path has a first feed path connected to the developer supply part and a second feed path connected to the developer collecting part, wherein the developer is supplied via the first feed path to the developer supply part by an air current, and the developer is collected from the developer extraction port and from the developer collecting part via the second feed path.

In another example, the developer extraction port is structured as a pathway located between a developer introducing position at an upstream of a developer feed direction of the developer supply part and a developer collecting position at a downstream of a developer feed direction of the developer collecting part, the pathway being connected to the reservoir.

In the second aspect of the invention, a developing device includes:

a developing unit configured to visualize an electrostatic latent image formed on a latent image support member using a developer that contains toner and carrier, the developing unit including a developer supply part and a developer collecting part; and a circulation path configured to collect the developer from the developing unit and feed the collected developer to the developer supply part, the circulation path including a reservoir provided before the developing unit to store and stir the developer, wherein the developer supply part and the developer collecting part are arranged parallel to each other at different heights and connected to each other via a bypass provided outside the developer supply part and the developer collecting part, the bypass being positioned behind a feed start position of a developer feeding member of the developer supply part and serving to define a quantity of developer to be introduced in the developer supply part.

In this structure, the bypass may have a dam provided on a side of the developer supply part to define the quantity of developer and to allow excessive developer to overflow into the developer collecting part.

In the third aspect of the invention, a developing device includes:

a developing unit configured to visualize an electrostatic latent image formed on a latent image support member using a developer that contains toner and carrier, the developing unit including a developer supply part and a developer collecting part; and a circulation path configured to collect the developer from the developing unit and feed the collected developer to the developer supply part, the circulation path including a reservoir provided before the developing unit to store and stir the developer, wherein the developer supply part and the developer collecting part are arranged parallel to each other in a horizontal direction, the developer supply part being connected to the reservoir via a supply feed path and a developer inlet port formed therein, the developer collecting part being connected to the reservoir via a collecting feed path and a developer outlet port, and wherein the developer inlet port functions to define a quantity of developer to be introduced in the developer supply part.

In this structure, a downstream of a feeding direction of the supply feed path connected to the reservoir and a downstream of a feeding direction of the collecting feed path may be connected to each other with a roundabout path.

For example, the developer supply part and the developer collecting part of the developing unit are arranged adjacent to each other in the horizontal direction.

As an example, the reservoir is furnished with a screw member and a stirring member provided at the circumference of the screw member to stir the developer, while allowing the developer to move upward; the supply feed path is connected to a top part of the reservoir at which the stirred developer starts flowing; and the collecting feed path is connected to a lower part of the reservoir at which the developer starts moving upward.

A new toner supply unit may be connected to the reservoir.

In the fourth aspect of the invention, an image forming apparatus using any one of the above described developing device is provided.

According to the above-described features, a developer extraction port is provided on the side of the developer inlet port receiving the developer from the reservoir, and defines the quantity of developer to be introduced in the developer supply part of the developing device. Accordingly, a constant quantity of developer is supplied to the developer supply part. The developer extraction port is connected to the reservoir, and the developer collecting part of the developing device is also connected to the reservoir. Accordingly, an excess quantity of developer over the defined quantity required for the developer supply part is collected in the reservoir. Even if the quantity of developer varies according to changes in the environmental conditions, the quantity of the developer supplied to the developer supply part is maintained constant. This arrangement can prevent abnormal image reproduction due to shortage of the developer or dispersing of the particles due to excessive supply of the developer.

DETAILED DESCRIPTION OF THE EMBODIMENTS

Figure 1:
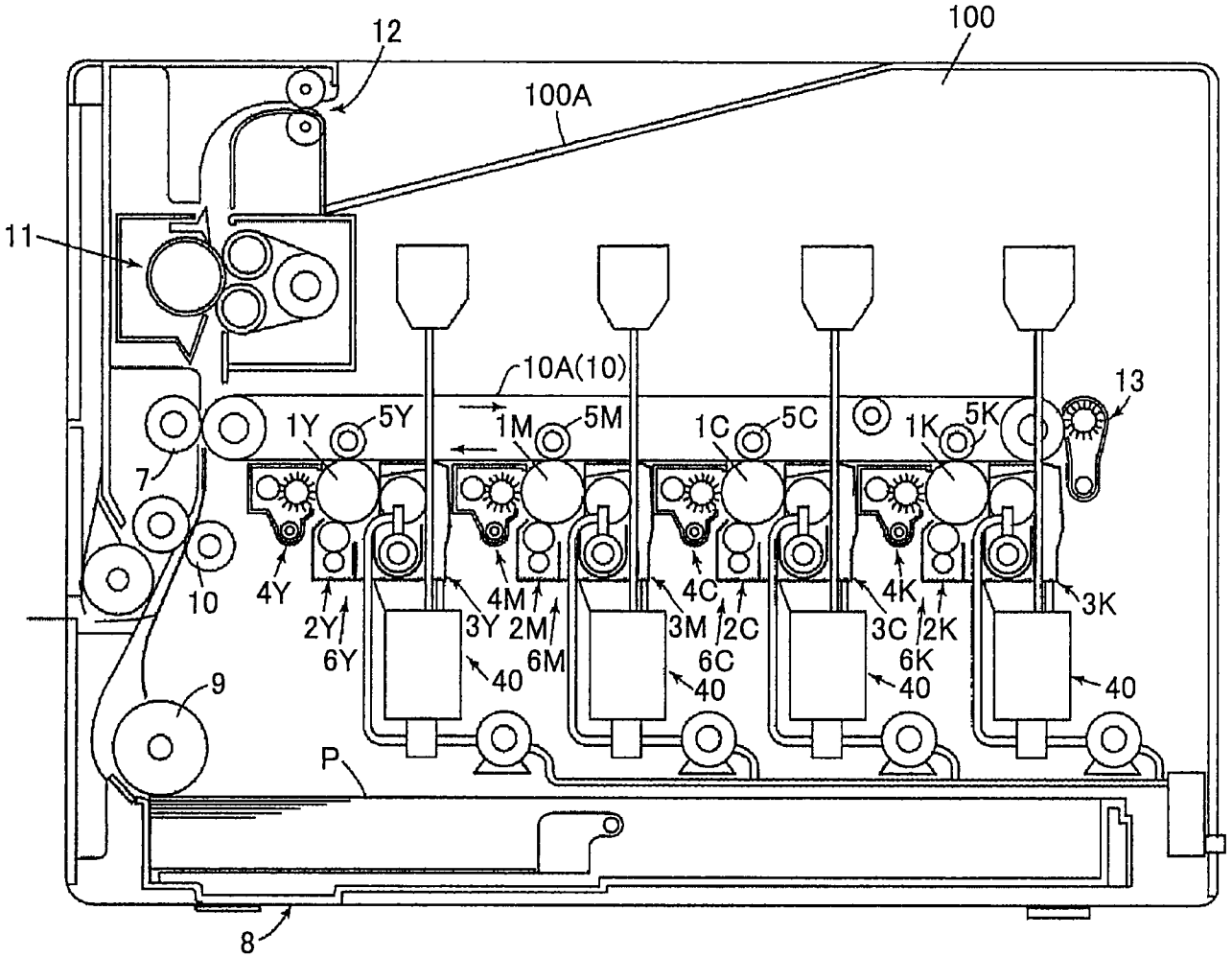
FIG. 1 is a schematic cross-sectional view of an image forming apparatus in which a developing device of an embodiment is used.

The preferred embodiments of the present invention will now be described below in conjunction with the attached drawings. FIG. 1 is a schematic diagram of an image forming apparatus using a developing device according to an embodiment of the invention. The image forming apparatus shown in FIG. 1 is, for example, a tandem-type full-color printer. However, the invention is not limited to this example and it is applicable to many other image forming apparatuses including copy machines and facsimile machines.

The image forming apparatus shown in FIG. 1 has four image creating units 6Y, 6M, 6C and 6K for creating color images of yellow (Y), magenta (M), cyan (C) and black (K), respectively, which units are arranged under an intermediate transfer unit 10 so as to face the bottom face of an intermediate transfer belt 10A that carries unfixed images in a body frame 100 of the image forming apparatus.

The image creating units 6Y, 6M, 6C and 6K have the same structure except that the colors of the toner used in image formation are different. In the explanation below, alphabetical symbols representing the colors of the toner are omitted and only the common numerical symbols are cited.

Each of the image creating units 6 has a photoreceptive drum 1 that carries a latent image on its surface. Around the photoreceptive drum 1 are arranged electrification means 2, a developing device 3, cleaning means 4 and other components. An image creating process (including electrification, exposure, development, image transfer, and cleaning steps) is carried out on the photoreceptive drum 1 to create a desired toner image on the drum 1. The photoreceptive drum 1 is rotated by a driving unit (not shown) in the counterclockwise direction in this drawing, and the surface is electrically charged in a uniform fashion at a position corresponding to the electrification means 2 (electrification step).

The electrically charged surface of the photoreceptive drum 1 reaches the irradiation position of a laser beam emitted by an exposure unit (not shown), and an electrostatic latent image is created at this position by scanning of the exposure light beam (exposure step). Then, the exposed surface reaches a position facing the developing device 3 and subjected to a visualizing process carried out by the developing device 3 by supplying toner particles contained in the developer onto the photoreceptive drum 1 (development step).

The surface of the photoreceptive drum 1 bearing the visualized toner image reaches a position facing the intermediate transfer belt 10A and a primary transfer bias roller 5, at which position the toner image on the photoreceptive drum 1 is transferred onto the intermediate transfer belt 10A (Primary transfer step).

The surface of the photoreceptive drum 1 from which the toner image has been transferred reaches a position facing the cleaning means 4, at which position the residual toner particles remaining on the drum surface are collected (cleaning step). After the cleaning, the electric potential of the surface of the photoreceptive drum 1 is neutralized by a neutralization roller (not shown). Thus, a series of steps in the image creating process performed on the photoreceptive drum 1 is completed.

The above-described image creating process is carried out when creating black-and-white images, as well as creating full-color images. When creating a full-color image, each of the four image creating units 6Y, 6M, 6C and 6K performs the image creating process. That is, a laser beam is emitted according to image data from the exposure unit (or the optical writing device) placed under the image creating part although not shown in the figure onto the corresponding one of the photoreceptive drums of the image creating units 6Y, 6M, 6C and 6K. The latent image is developed into a toner image of the corresponding color and the toner images of the respective colors are transferred onto the intermediate transfer belt 10A. Thus, a full-color image is formed on the intermediate transfer belt 10A.

The four primary transfer bias rollers 5Y, 5M, 5C and 5K are paired with the photoreceptive drums 1Y, 1M, 1C and 1K to nip the intermediate transfer belt 10A between them. This arrangement structures primary transfer nips. A transfer bias opposite to the polarity of the toner is applied to each of the primary transfer bias rollers 5K, 5C, 5M and 5Y. The intermediate transfer belt 10A is driven in the arrowed direction and successively passes through the primary transfer bias rollers 5Y, 5M, 5C and 5K of the primary transfer nip. Thus, the toner images on the photoreceptive drums 1Y, 1M, 1C and 1K are superimposed over the intermediate transfer belt 10A.

The intermediate transfer belt 10A bearing the superimposed toner image of the full color reaches a position facing a secondary transfer roller 7 which serves as the secondary transfer means. The color toner image on the intermediate transfer belt 10A is then transferred onto a sheet of transfer paper P (recording medium) which has been fed to the position of the secondary transfer nip.

A paper feeding unit 8 provided at the bottom of the body frame 100 of the apparatus accommodates a stack of paper, which is separated into individual sheets of paper by a paper feed roller 9 and fed to the paper feed path. The transfer sheet P fed from the paper feeding unit 8 is stopped at a pair of resist rollers 10 for correction of oblique slip and then fed at a prescribed timing to the secondary transfer nip, where a full-color image is transferred onto the transfer sheet P.

The transfer sheet P bearing the color image is fed from the secondary transfer nip to a fixing device 11, at which the color image is fixed to the paper surface under the application of heat and pressure by means of a fixing roller and a pressure roller.

The transfer sheet P bearing the fixed image is ejected as an output image by a pair of ejection rollers and stacked onto the ejection tray (catch tray) provided on the top of the body frame 100 of the apparatus. Then a sequence of an image forming process in the image forming apparatus is completed. The numerical reference 13 illustrated in FIG. 1 represent a cleaning device for the intermediate transfer belt 10A.

Figure 2:
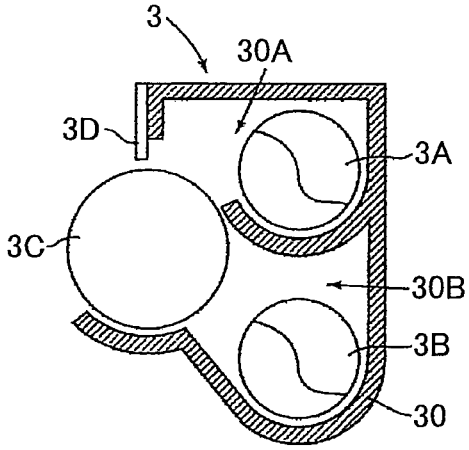
FIG. 2 is a schematic diagram of the developing device according to an embodiment of the invention.

FIG. 2 is a schematic cross-sectional view of the developing device 3 used as a developing unit of the image creating part according to an embodiment of the invention.

The developing device has a developer tank 30 that includes a developer supply part 30A and a developer collecting part 30B. A developer supply member 3A comprised of a feed screw is provided in the developer supply part 30A and a developer collecting member 3B comprised of a feed screw is provided in the developer collecting part 30B. The two feed screws extend parallel to each at different heights.

A development sleeve 3C adapted to carry the developer on its surface is positioned facing the developer supply member 3A so as to receive the developer from the developer supply member 3A. The thickness of the developer on the development sleeve 3C is regulated into an even layer by the doctor blade 3D and the uniformly regulated developer is to be supplied onto the photoreceptive drum.

The rotational directions of the developer supply member 3A and the developer collecting member 3B are opposite to each other. The developer supply part 30A and the developer collecting part 30B are arranged so as to be included in the circulation path of the developer supply mechanism shown in FIG. 3.

Figure 3:
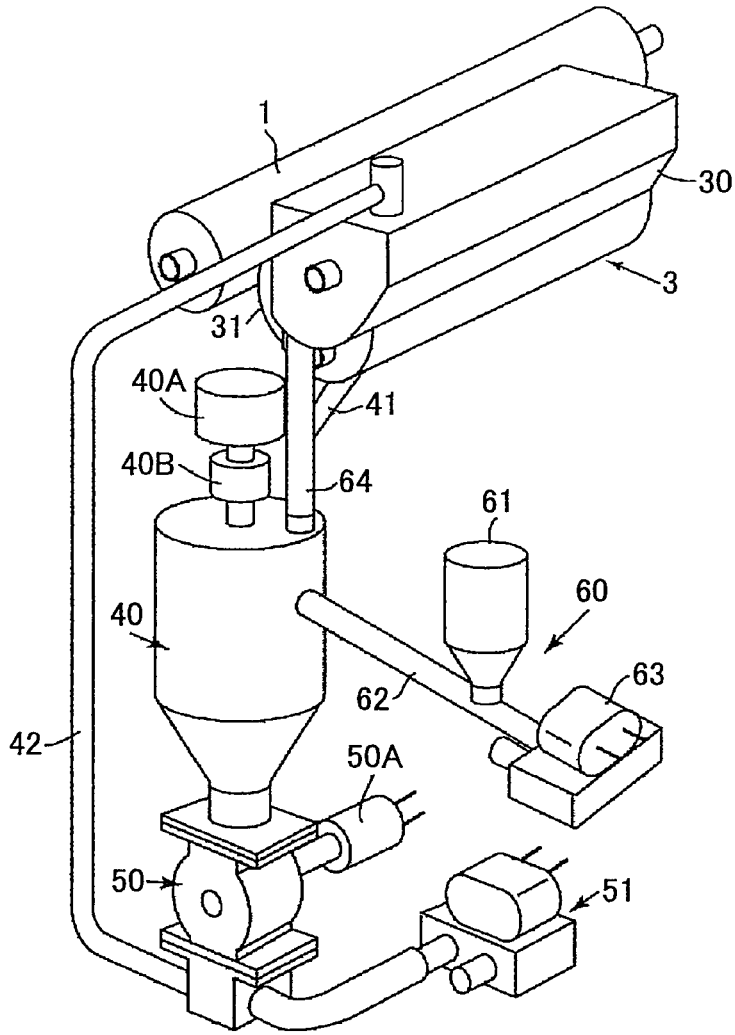
FIG. 3 is a perspective view of a developer supply mechanism applied to the developing device shown in FIG. 2.

FIG. 3 illustrates the overall structure of the developer supply mechanism. The developing device 3 includes a developer tank 30, a developer reservoir 40, a toner supply unit 60, a rotary feeder 50, and an air pump 51 as major components. The developer tank 30 accommodates a developer used to develop the electrostatic latent image on the photoreceptive drum 1. The developer reservoir 40 is located separate from the developer tank 30, and new toner particles are introduced into the developer reservoir 40 to compensate for the consumed toner particles. The developer reservoir 40 stirs and mixes the developer collected from the developer tank 30 with the newly supplied toner particles. The new toner particles are supplied to the developer reservoir 40 from the toner supply unit 60. The rotary feeder 50 receives the stirred and mixed developer from the developer reservoir 40 and feeds the stirred/mixed developer. The air pump 51 serves as a circulation driving source and it delivers the developer into the developer tank 30 by means of the air pressure. In FIG. 3, the developer tank 30 is shaped into a cartridge.

The developer tank 30 and the developer reservoir 40 are connected to each other via a developer collection flow path 41 and a developer supply flow path 42. The developer collection flow path 41 is connected to the developer collecting part 30B (see FIG. 2) of the developer tank 30. The developer supply flow path 42 is connected to the developer supply part 30A (see FIG. 2) of the developer tank 30. The flow paths 41 and 42 form a developer circulation path, and the developer circulation path and the components arranged on the developer circulation path structure a circulation unit.

Figure 4:
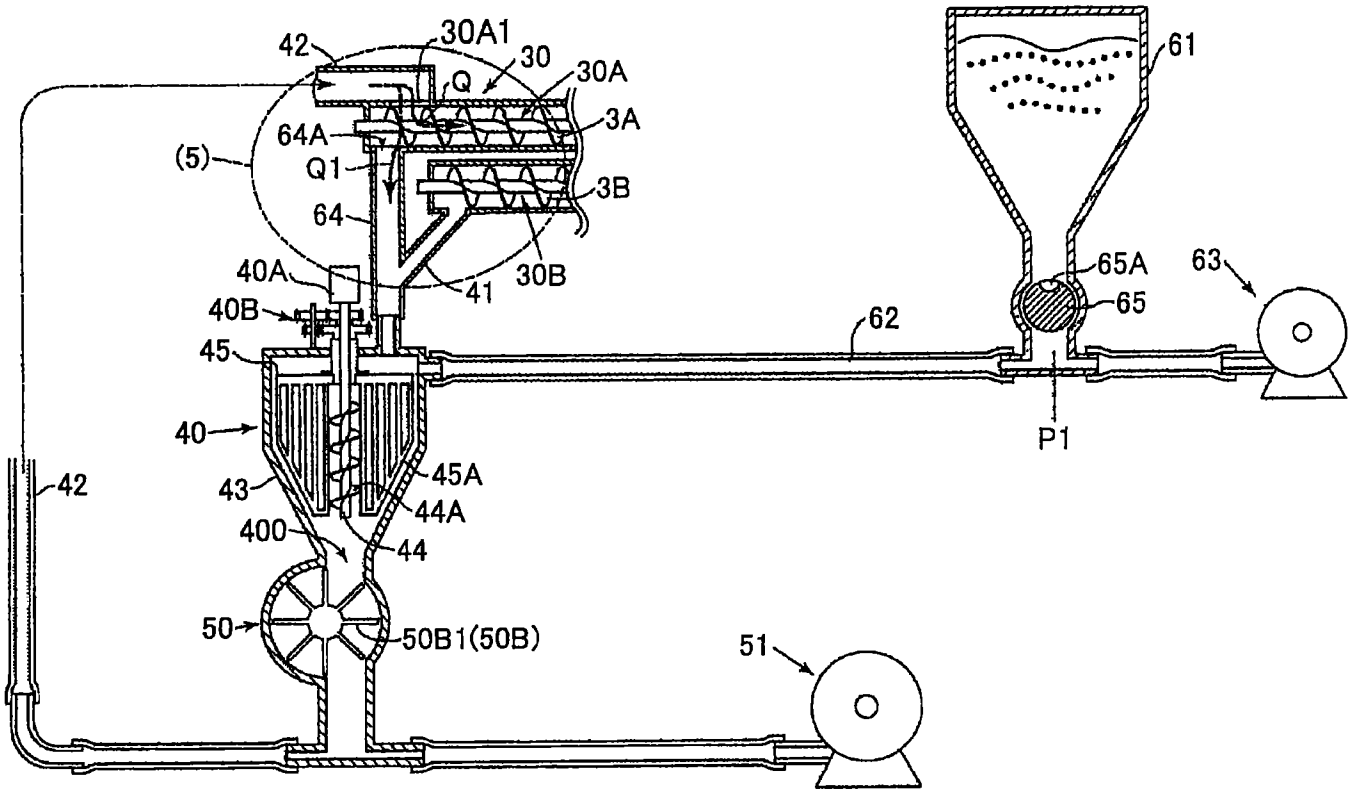
FIG. 4 is an interior elevation view of the developer supply mechanism shown in FIG. 3.

Referring to FIG. 4, the developer supply flow path 42 is connected to the developer tank 30 at one end of the developer supply member 3A in the axial direction. To be more precise, the developer supply flow path 42 is connected to the developer tank 30 so as to face a developer feeding start position located upstream of the developer feeding direction of the developer supply member 3A. The developer collection flow path 41 is connected to a developer ejecting position of the developer collecting member 3B, the developer ejecting position being located downstream of the developer feeding direction of the developer collecting member 3B. The upper part of the developer reservoir 40 is cylindrical while the bottom part thereof is conical pointing downward. The developer reservoir 40 has an appearance of a silo. A stirring member is provided inside the developer reservoir 40, the details of which will be described below.

The top of the developer reservoir 40 is furnished with a driving motor 40A that serves as a driving unit for the stirring member, as well as a set of reduction gears (collectively denoted by symbol 40B in FIG. 4). The developer having been stirred and mixed in the developer reservoir 40 is supplied to the rotary feeder 50 which has paddles 50B inside to regulate the feed rate of the developer. The rotary feeder 50 is rotated by a driving motor 50A. The feed-rate regulated developer is then supplied to the developing tank 30 by means of the air current generated by the air pump 51.

The toner supply unit 60 includes a toner tank 61, a toner supply path 62 extending between the toner tank 61 and the developer reservoir 40, and an air pump 63 for feeding the toner particles supplied in the toner supply path 62 by the air current.

Residual developer still remaining after the development process is fed to the developer reservoir 40 via the developer collection flow path 41 (see FIG. 3) connected to the end of the collecting feed screw (i.e., the developer collecting member) 3B.

A toner concentration sensor (not shown) is placed at the most downstream of the collecting feed screw 3B, and new toner particles are supplied from the toner tank 61 in response to the signals generated by the concentration sensor. As has been described above, the toner particles are delivered by the air current produced by the air pump 63 connected to the toner supply path 62.

The developer reservoir 40 shown in FIG. 3 has a container 43 having a funnel shape extending from a cylinder part and narrowing downward, as illustrated in FIG. 4. The lowermost part with the smallest diameter is an outlet port in communication with the rotary feeder 50.

A screw 44A and stirring blades 45A are arranged inside the developer reservoir 40. The screw 44A is provided around the rotary shaft 44 extending downward from the motor 40A to structure and serve as a stirring member, which rotates so as to feed the developer in the opposite direction of the developer flow. The stirring blades 45A have an end plate 45 that is engaged with the output gear of the reduction gear set 40B driven by the rotary shaft 44. The stirring blades 45A extend from the end plate and are arranged in a radial fashion. Multiple slits are formed in each of the stirring blades 45A so as to allow a portion of the developer to pass through, while pushing and stirring the other portion of the developer, thereby agitating the developer.

The rotary feeder 50 is connected to an outlet port 400 located the lowermost part of the container 43 to control the feed rate of the developer according to the rotation rate of the motor 50A (FIG. 3). The rotary feeder 50 has a rotary valve 50B with multiple paddles 50B1 fixed to the rotary shaft of the motor 50A in a radial fashion.

Based upon the above-described structure, the advantageous features of the embodiment are further described below.

Figure 5:
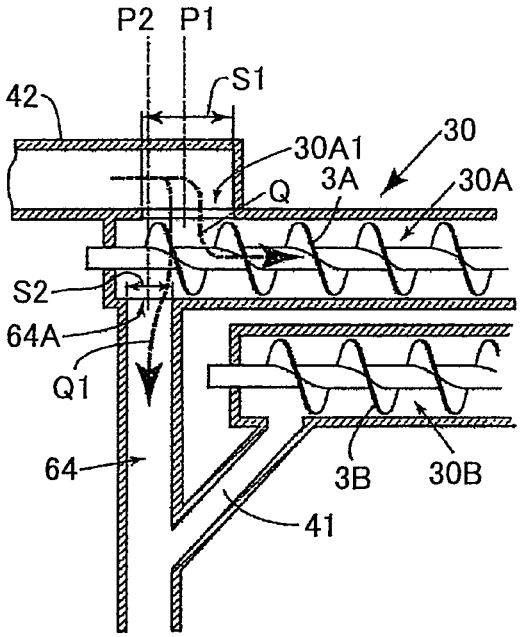
FIG. 5 is an enlarged view of the characterizing part of the developer supply mechanism shown in FIG. 4.

FIG. 4 is an interior elevation view of the developer supply mechanism shown in FIG. 3. FIG. 5 is an enlarged view of the major part (5) circled in FIG. 4. In FIG. 4, the developer supply part 30A and the developer collecting part 30B are arranged in the developing device 3 such that the end portion of the developer supply part 30A and the end portion of the developer collecting part 30B of the same side are offset from each other. A developer extraction port 64A is provided on the side of the developer inlet port 30A1 of the developer supply part 30A. The developer inlet port 30A1 receives the developer supplied from the developer reservoir 40. A developer collecting path 64 extends from the developer extraction port 64A in order to collect the extracted developer and is connected to the developer reservoir 40 to return the collected developer.

The developer collection flow path 41 extending from the developer collecting part 30B of the developing device 3 joins the developer collecting path 64. Accordingly, the developer extraction port 64A and the developer collecting part 30B are connected to the developer reservoir 40.

The developer extraction port 64A is formed as an opening at the bottom of the developer supply part 30A so as to allow the developer introduced in the developer supply part 30A to fall under its own weight into the developer collecting path 64. In this regard, the developer extraction port 64A functions to define the quantity of the developer to be introduced in the developer supply part 30A.

To define the quantity of the developer to be introduced in the developer supply part 30A, a particular structure is employed. The developer extraction port 64A is provided such that the center P2 of the port 64A is offset from the center P1 of the developer supply port 30A to which the developer supply flow path 42 extending from the developer reservoir 40 is connected, as illustrated in FIG. 5. The amount of positional offset of the center P2 with respect to the center P1 of the developer inlet port 30A1 corresponds to at least one screw blade of the developer supply member 3A along the axle toward the end of the screw.

In other words, the developer extraction port 64A overlaps the feed start position of the developer supply part 30A, and the bottom of the developer supply part 30A extends so as to overlap the developer inlet port 30A1 to receive the developer.

The area size of the opening of the developer extraction port 64A is determined such that a quantity of developer being extracted is less than the quantity of the developer to be introduced through the developer inlet port 30A1 and fed by the developer supply member (screw) 3A. Especially, the area size S2 of the opening of the developer extraction port 64A is less than the area S1 of the developer inlet port 30A1.

The area size S2 of the opening of the developer extraction port 64A is selected such that a quantity of circulation of the developer being introduced from the developer inlet port 30A1 surely satisfies a defined quantity required for the developer supply part 30A. Concurrently, an excess quantity of developer over the defined quantity of circulation (i.e., a subtraction of the defined quantity of circulation required in the developer supply part 30A from the quantity of developer supplied from the developer reservoir 40) is collected and fed back to the developer reservoir 40.

A portion of the developer introduced through the developer inlet port 30A1 into the developer supply part 30A is output from the developer extraction part (the developer extraction port 64A in this example). When the developer having passed through the developer inlet port 30A1 comes into contact with the endmost blade of the developer supply member (screw) 3A, a portion of the developer is received at the bottom of the developer supply part 30A and moved forward according to the rotation of the screw blade, as indicated by the arrow Q.

On the other hand, excessive developer over the defined quantity of circulation required in the developer supply part 30A flows into the developer collecting path 64 through the developer extraction port 64A under its own weight, as illustrated by the arrow Q1, separated from the developer flow in the developer supply part 30A indicated by the arrow Q.

By supplying from the developer reservoir 40 a sufficient quantity of developer over the defined circulation quantity required in the developer supply part 30A, shortage of developer in the developer supply part 30A can be obviated. Since the excessive quantity of developer is removed through the developer extraction port 64A and fed back to the developer reservoir 40 via the developer collecting path 64, the defined quantity of circulation is always satisfied in the developer supply part 30A. This arrangement can prevent not only reproduction of abnormal images due to shortage of developer, but also contamination on the periphery of the developing device due to an excess quantity of developer introduced in the developing device.

Figure 6:
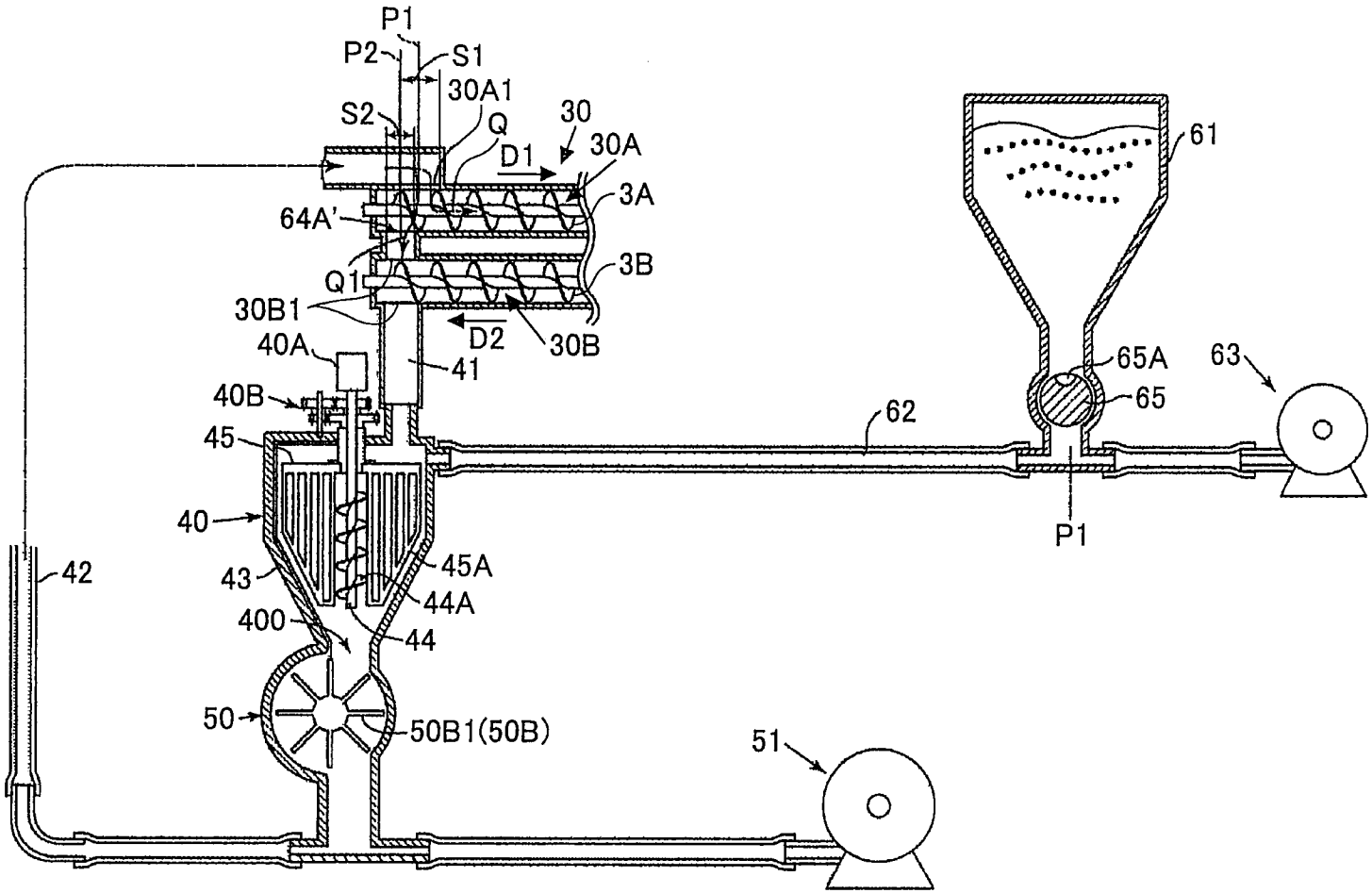
FIG. 6 is an interior elevation view of a developer supply mechanism used in a developing device according to another embodiment of the invention.

Next, another embodiment of the invention is described below. The developing device 3 of FIG. 2 is used in the structure shown in FIG. 6 as in the previously described embodiment; however, the structure of the developer extraction port 64A is different.

Prior to explaining the developer extraction part, explanation is made of the structures of the developer supply part 30A and the developer collecting part 30B of the developing device 3. The developer supply part 30A has a developer supply member (screw) 3A, and the developer collecting part 30B has a developer collecting member (screw) 3B as in the previous embodiment. However, in this embodiment, the lengths of the axles and the positions of the endmost screw blades of the developer supply member 3A and the developer collecting member 3B are the same.

Under this arrangement, the developer extraction port 64A' is located near the developer inlet port 30A1 at the upstream of the developer feeding direction D1 of the developer supply part 30A, while facing the developing collecting port 30B1 at the downstream of the developer feeding direction D2 of the developer collecting part 30B. Thus, the developer extraction port 64A' is in communication with the developer collecting part 30B. The developer collecting port 30B1 is connected via the developer collection flow path 41 to the developer reservoir 40.

The center of the developer extraction port 64A' is offset from the center of the developer inlet port 30A1 as in FIG. 5 in such a manner that at least one end blade on the axle of the developer collecting member 3B receives the developer in the developer collecting part 30B. The area size of the opening of the developer extraction port 64A' is determined so as to satisfy the conditions explained in conjunction with FIG. 5.

With this arrangement, the developer collection flow path 41 can be used to collect excessive developer over the defined quantity from the developer supply part 30A, and the developer circulation path can be simplified as compared with FIG. 4.

FIG. 7 illustrates still another embodiment of the invention. The structure of FIG. 7 is applied to the developing device 3 shown in FIG. 2 in which the developer supply part 30A and the developer collecting part 30B extend parallel to each other at different heights.

Figure 7A:
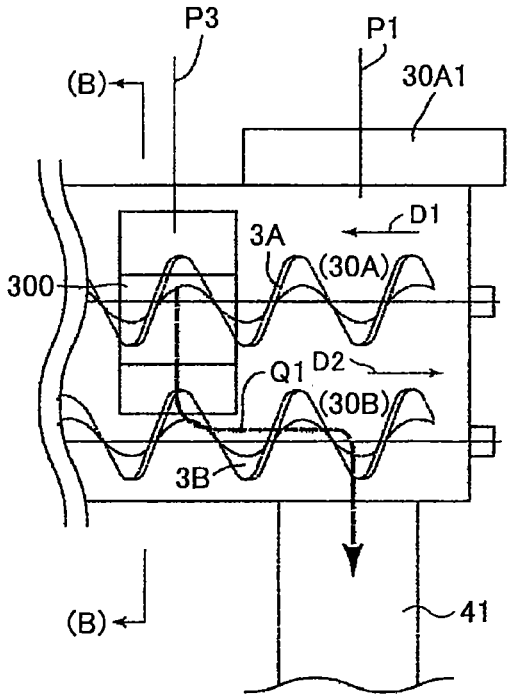
FIG. 7A through FIG. 7C are diagrams for explaining the characterizing part of the developer supply mechanism shown in FIG. 6.

In FIG. 7A, the developer supply part 30A of the developing device 3 is provided with a developer inlet port 30A1 at the upstream of the developer feed direction D1 of the developer supply member 3A. The developer collecting part 30B is provided with a developer outlet port at the downstream of the developer feed direction D2 of the developer collecting member 3B so as to be in communication with the developer collection flow path 41.

Figure 7B:
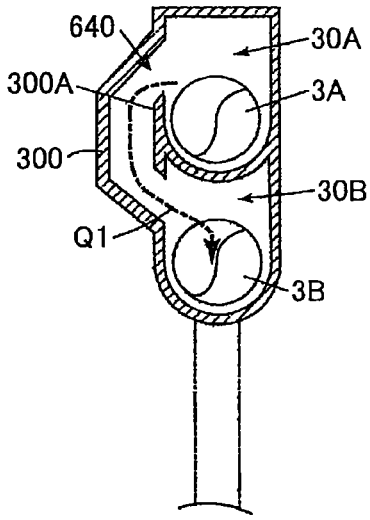

As illustrated in FIG. 7B, the developer supply part 30A and the developer collecting part 30B are in communication with each other via a bypass 300 provided as a part of the developer tank 30 of the developing device 3. A dam 300A is provided in the bypass 300 on the side of the developer supply part 30A to form a developer extraction port 640.

The area size of the opening of the developer extraction port 640 at the dam 300A is set smaller than that of the developer inlet port 30A1. Accordingly, excessive developer over the defined quantity of circulation required for the developer supply part 30A (which is a subtraction of the defined quantity of circulation from the quantity of developer supplied from the developer reservoir 40) overflows into the bypass 300.

The bypass 300 is positioned offset from the center P1 of the developer inlet port 30A1 at the upstream of the developer feed direction of the developer supply member 3A and the downstream of the developer collecting member 3B, as indicated by symbol P3 in FIG. 7A.

The offset is determined such that the bypass 300 is located outside the image forming area of the developer sleeve 3C (FIG. 2) and that the quantity of developer fed in the developer supply part 30A is defined so as to satisfy the circulation required in the developer supply part 30A.

Figure 7C:
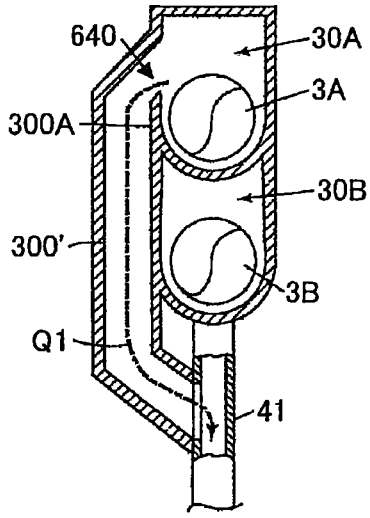

The bypass 300 may be modified as a bypass 300' which is connected directly to the developer collection flow path 41 from the developer supply part 30A, as illustrated in FIG. 7C.

With this arrangement, when an excess quantity of developer is supplied from the developer reservoir 40 over a necessary quantity required for the circulation in the developer supply part 30A, the bypass 300 or 300' allows the excessive developer to overflow from the dam 300A of the developer extraction port 640 into the developer collecting part 30B or into the developer collection flow path 41 under its own weight.

The necessary quantity of circulation of developer is guaranteed in the developer supply part 30A, while the excessive developer over the defined quantity (that is, the subtraction of the defined quantity of circulation from the supplied quantity of developer) is fed back to the developer reservoir 40 via the developer collection flow path 41. Because excessive developer can be collected from the developing device or from the developer supply part 30A of the developing device directly to the developer reservoir 40, the length of the circulation path can be reduced. The workload for driving the air pump can also be reduced by preventing the air pressure from increasing during the feeding using the air current.

Next, explanation is made of still another embodiment of the invention.

Figure 8:
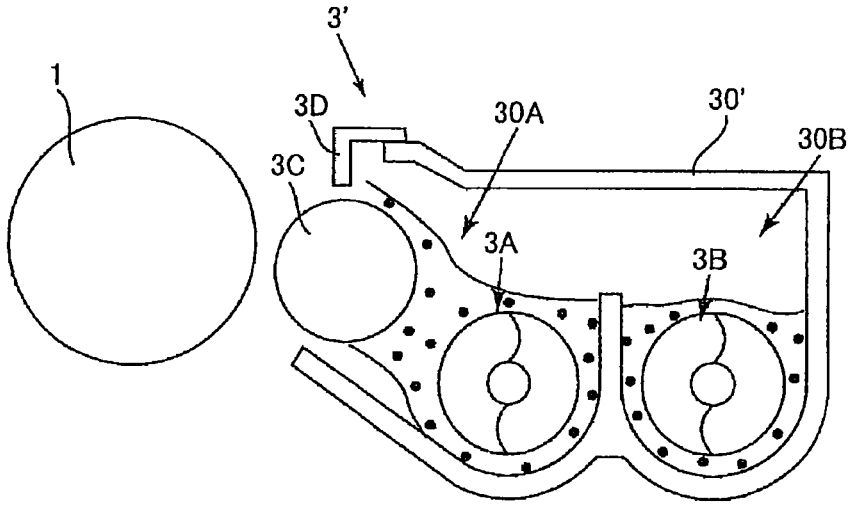
FIG. 8 is an interior elevation view of a developer supply mechanism used in a developing device according to still another embodiment of the invention.

FIG. 8 illustrates the interior of the developing device 3'. In this embodiment, the developer supply member 3A and the developer collecting member 3B are arranged parallel to each other in the horizontal direction, unlike the structure shown in FIG. 2. Accordingly, the developer supply part 30A and the developer collecting part 30B arranged in the developer tank 30 are also positioned adjacent to teach other in the horizontal direction.

The developing device 3' has the advantageous structure of the circulation path as described below.

Figure 9:
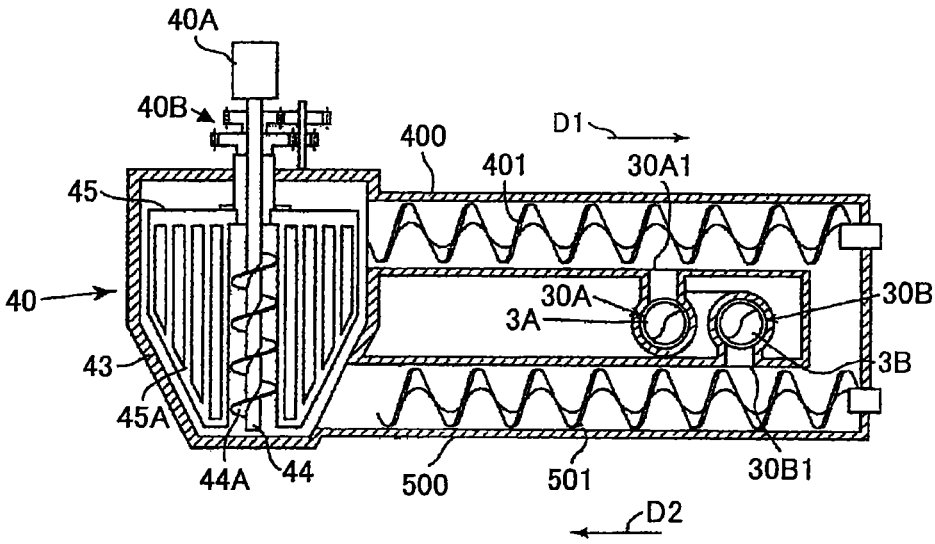
FIG. 9 is a schematic diagram showing the inner structure of the developer supply mechanism shown in FIG. 8.

FIG. 9 illustrates a developer circulation path connecting the developer reservoir 40 and the developer supply part 30A and the developer collecting part 30B of the developing device. The developer circulation path includes a supply feed path 400 connected to the developer supply side of the developer reservoir 40, the developer supply part 30A and the developer collecting part 30B of the developing device, and the collection feed path 500 connected to the developer collection side of the developer reservoir 40.

The developer supply part 30A is in communication with the supply feed path 400 via a developer inlet port 30A1 that is provided in the supply feed path 400 to serve as the developer introducing port. The developer collecting part 30B is in communication with the collecting feed path 500 via the developer collecting port 30B1.

In FIG. 9, the supply feed path 400 is connected to the top part of the developer reservoir 40, and the collecting feed path 500 is connected to the bottom part of the developer reservoir 40. The feed paths 400 and 500 are connected to each other via a roundabout path at the distant end from the reservoir 40. Feed screws 401 and 501 are provided inside the supply feed path 400 and the collecting feed path 500, respectively, to feed the developer. The rotational directions of the feed screws 401 and 501 are opposite to each other.

The developer inlet port 30A1 for connecting the supply feed path 400 and the developer supply part 30A is located at the downstream of the feeding direction D1 of the feed screw 401 provided in the supply feed path 400. The developer outlet port 30B1 for connecting the collecting feed path 500 and the developer collecting part 30B is located at the upstream of the developer feeding direction D2 of the feed screw 501 provided in the collecting feed path 500.

The area size of the opening of the developer inlet port 30A1 is selected so as to introduce only the necessary quantity of developer required for circulation through the developer supply part 30A. Excessive developer is fed to the roundabout path connected to the developer collecting part 30B by means of the rotation of the feed screw 401.

By appropriately selecting the feeding quantity and the rotation rate of the blade of the feed screw 401, a portion of the developer passing through the developer inlet port 30A1 is taken into the developer supply part 30A, and the remaining portion is pushed toward the roundabout path.

If the feeding quantity per screw blade is known, only the necessary quantity of circulation can be fed to the developer supply part 30A by appropriately selecting the number of rotations and the rotation time of the screw blade at the developer inlet port 30A1, while preventing the entirety of the supplied developer from being taken into the developer supply part 30A from the developer inlet port 30A1. The developer having passed over the developer inlet port 30A1 is introduced via the roundabout path to the collecting feed path 500, and fed together with the developer output from the developer collecting part 30B to the developer reservoir 40.

The developer introduced in the developer reservoir 40 is moved upward by means of the screw 44, and concurrently stirred and mixed by the shear action of the stirring blades 45A. Through this process, the developer is frictionally charged. The electrified developer again moves along the supply feed path 400 and is taken in the developer supply port 30A.

In the developer reservoir 40, the developer easily moves upward due to the centrifugal force produced by the cross-sectional shape of the container 43 and the rotation of the stirring blades 45A. Making use of this phenomenon, the supply feed path 400 is connected to the top of the container 43 and the collecting feed path 500 is connected to the lower part of the container 43.

Figure 10:
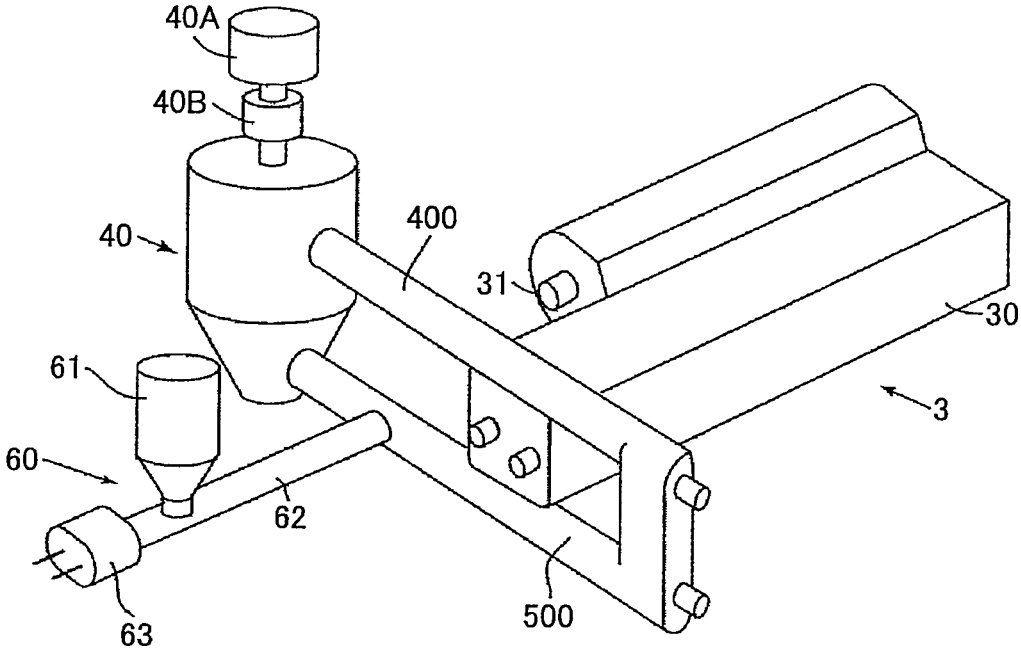
FIG. 10 is an external view of the developer supply mechanism shown in FIG. 9.

FIG. 10 is an external perspective view of the developer supply mechanism shown in FIG. 9. The developer is supplied from the supply feed path 400 to the developer supply part 30A of the developing device 3 making use of the weight of the developer itself. The developer is collected from the developer collecting part 30B to the collecting feed path 500 making use of the weight of the developer itself. Thus, the developing device 3 is inserted between the supply feed path and the collecting feed path. This arrangement can save the space required for the developing device 3 in the vertical direction.

Figure 11:
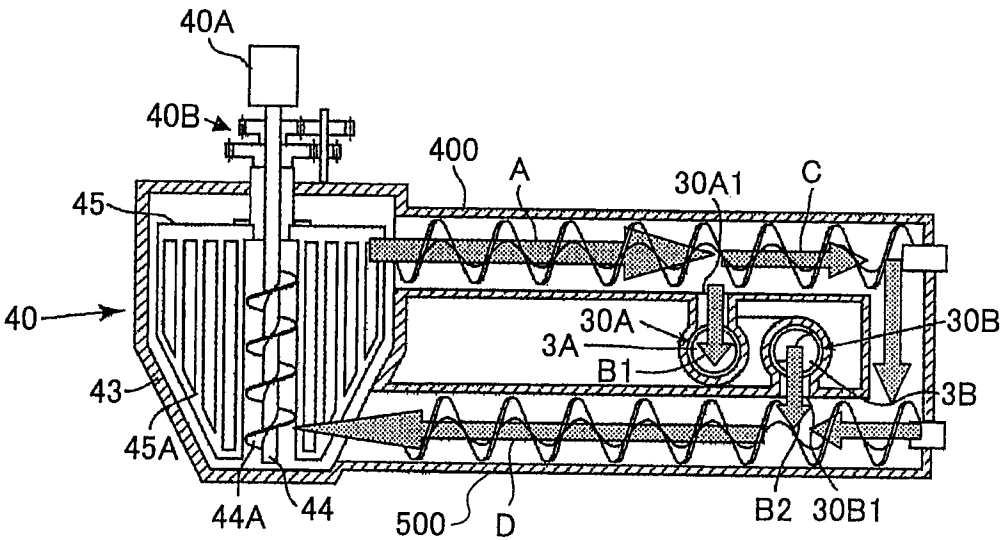
FIG. 11 is a schematic diagram for explaining the feeding state of the developer in the developer feeding mechanism shown in FIG. 9 and illustrating the inner structure thereof.

FIG. 11 is a schematic diagram showing the advantageous effect of the developer supply mechanism shown in FIG. 9. This figure shows the flow of the developer and the feeding quantities at several positions that satisfy the relationship expressed by the equations.

In this embodiment, feed quantity A supplied from the developer reservoir 40 is set so as to be greater than feed quantities B1 and B2 required for the developer supply part 30A and the developer collecting part 30B, respectively. Even if the feed quantity A varies, feed quantities B1 and B2 required in the developer supply part 30A and the developer collecting part 30B of the developing device 3 do not change.

This international patent application claims the benefit of the earlier filing date of Japanese Priority Application No.

2010-059941 filed on Mar. 16, 2010, the entire contents of which are incorporated herein by reference.

The invention claimed is:

1. A developing device comprising:

a developing unit configured to visualize an electrostatic latent image formed on a latent image support member using a developer that contains toner and carrier, the developing unit including a developer supply part and a developer collecting part; and a circulation path configured to collect the developer from the developing unit and feed the collected developer to the developer supply part, the circulation path including a reservoir provided before the developing unit to store and stir the developer, wherein the developing supply part has a developer inlet port configured to introduce the developer supplied from the reservoir into the developing supply part and a developer extraction port provided on a side of the developer inlet port to remove a portion of the developer to define a quantity of developer to be introduced to the developer supply part, wherein the developer extraction port has an area size that removes a quantity of extracted developer, the quantity of extracted developer being less than a quantity of developer fed to a developer feeding member provided in the developer supply part at a feed start position of the developer feeding member, wherein the developer extraction port is structured as an opening overlapping the feed start position of the developer feeding member.

2. The developing device according to claim 1, wherein the developer extraction port is configured to allow said portion of the developer to be supplied to the reservoir.

3. The developing device according to claim 1, wherein a quantity of the developer supplied from the reservoir to the developer inlet port is at or above a defined quantity of circulation required for the developing supply part.

4. The developing device according to claim 1, wherein the developer extraction port is configured to collect an excess quantity of the developer over a defined quantity of circulation required for the developer supply part, making use of a weight of the developer itself.

5. The developing device according to claim 1, wherein the developer extraction port is structured as a pathway located between a developer introducing position at an upstream of a developer feed direction of the developer supply part and a developer collecting position at a downstream of a developer feed direction of the developer collecting part, the pathway being connected to the reservoir.

6. The developing device according to claim 1, wherein a new toner supply unit is connected to the reservoir.

7. An image forming apparatus comprising the developing device according to claim 1.

8. A developing device comprising:

a developing unit configured to visualize an electrostatic latent image formed on a latent image support member using a developer that contains toner and carrier, the developing unit including a developer supply part and a developer collecting part; and a circulation path configured to collect the developer from the developing unit and feed the collected developer to the developer supply part, the circulation path including a reservoir provided before the developing unit to store and stir the developer, wherein the developing supply part has a developer inlet port configured to introduce the developer supplied from the reservoir into the developing supply part and a developer extraction port provided on a side of the developer inlet port to remove a portion of the developer to define a quantity of developer to be introduced to the developer supply part, wherein the reservoir provided in the circulation path has a first feed path connected to the developer supply part and a second feed path connected to the developer collecting part, and wherein the developer is supplied via the first feed path to the developer supply part by an air current, and the developer is collected from the developer extraction port and from the developer collecting part via the second feed path.

9. The developing device according to claim 8, wherein a new toner supply unit is connected to the reservoir.

10. An image forming apparatus comprising the developing device according to claim 8.

11. A developing device comprising:

a developing unit configured to visualize an electrostatic latent image formed on a latent image support member using a developer that contains toner and carrier, the developing unit including a developer supply part and a developer collecting part; and a circulation path configured to collect the developer from the developing unit and feed the collected developer to the developer supply part, the circulation path including a reservoir provided before the developing unit to store and stir the developer, wherein the developer supply part and the developer collecting part are arranged parallel to each other at different heights and connected to each other via a bypass provided outside the developer supply part and the developer collecting part, the bypass being positioned behind a feed start position of a developer feeding member of the developer supply part and serving to define a quantity of developer to be introduced in the developer supply part, and wherein the bypass has a dam provided on a side of the developer supply part to define the quantity of the developer and to allow excessive developer to overflow into the developer collecting part.

12. The developing device according to claim 11, wherein a new toner supply unit is connected to the reservoir.

13. An image forming apparatus comprising the developing device according to claim 11.

* * * * *